US007048519B2

(12) United States Patent
Fong et al.

(10) Patent No.: US 7,048,519 B2
(45) Date of Patent: May 23, 2006

(54) CLOSED-LOOP PIEZOELECTRIC PUMP

(75) Inventors: Arthur Fong, Colorado Springs, CO (US); Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 305 days.

(21) Appl. No.: 10/412,857

(22) Filed: Apr. 14, 2003

(65) Prior Publication Data

US 2004/0202558 A1 Oct. 14, 2004

(51) Int. Cl.
*F04B 17/00* (2006.01)

(52) U.S. Cl. ..... 417/413.2

(58) Field of Classification Search ..... 417/413.2
See application file for complete search history.

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Tomkewitsch et al. |
| 3,529,268 | A | 9/1970 | Rauterberg |
| 3,600,537 | A | 8/1971 | Twyford |
| 3,639,165 | A | 2/1972 | Rairden, III |
| 3,657,647 | A | 4/1972 | Beusman et al. |
| 4,103,135 | A | 7/1978 | Gomez et al. |
| 4,200,779 | A | 4/1980 | Zakurdaev et al. |
| 4,238,748 | A | 12/1980 | Goullin et al. |
| 4,245,886 | A | 1/1981 | Kolodzey et al. |
| 4,336,570 | A | 6/1982 | Brower |
| 4,419,650 | A | 12/1983 | John |
| 4,434,337 | A | 2/1984 | Becker |
| 4,475,033 | A | 10/1984 | Willemsen et al. |
| 4,505,539 | A | 3/1985 | Auracher et al. |
| 4,519,751 | A | 5/1985 | Beckman et al. |
| 4,582,391 | A | 4/1986 | Legrand |
| 4,628,161 | A | 12/1986 | Thackrey |
| 4,652,710 | A | 3/1987 | Karnowsky et al. |
| 4,657,339 | A | 4/1987 | Fick |
| 4,742,263 | A | 5/1988 | Harnden, Jr. et al. |
| 4,786,130 | A | 11/1988 | Georgiou et al. |
| 4,797,519 | A | 1/1989 | Elenbaas |
| 4,804,932 | A | 2/1989 | Akanuma et al. |

(Continued)

FOREIGN PATENT DOCUMENTS

EP 0593836 A1 10/1992

(Continued)

OTHER PUBLICATIONS

Jonathan Simon, "A Liquid-Filled Microrelay With A Moving Mercury Microdrop" (Sep. 1997), Journal of Microelectromechanical Systems, vol. 6, No. 3. pp. 208-216.

(Continued)

*Primary Examiner*—Charles G. Freay

(57) ABSTRACT

A closed-loop piezoelectric pump is disclosed for use in a fluid delivery system. The pump housing includes a movable diaphragm that defines a pumping chamber within the pump housing, the pumping chamber having an inlet for admitting fluid and an outlet for emitting fluid. A piezoelectric transducer is coupled to the moveable diaphragm and operates to produce a pumping action by varying the volume of the pumping chamber. The piezoelectric transducer may be used to generate an acoustic pressure pulse within the fluid delivery system and to sense reflections of the acoustic pressure pulse caused by impedance changes downstream of the pump. Properties of the fluid path downstream of pump may be determined from the characteristics of the sensed reflections.

25 Claims, 7 Drawing Sheets

U.S. PATENT DOCUMENTS

| | | | | |
|---|---|---|---|---|
| 4,988,157 | A | 1/1991 | Jackel et al. | |
| 5,278,012 | A | 1/1994 | Yamanaka et al. | |
| 5,415,026 | A | 5/1995 | Ford | |
| 5,415,051 | A | 5/1995 | Rokugawa et al. | |
| 5,502,781 | A | 3/1996 | Li et al. | |
| 5,644,676 | A | 7/1997 | Blomberg et al. | |
| 5,675,310 | A | 10/1997 | Wojnarowski et al. | |
| 5,677,823 | A | 10/1997 | Smith | |
| 5,751,074 | A | 5/1998 | Prior et al. | |
| 5,751,552 | A | 5/1998 | Scanlan et al. | |
| 5,828,799 | A | 10/1998 | Donald | |
| 5,841,686 | A | 11/1998 | Chu et al. | |
| 5,849,623 | A | 12/1998 | Wojnarowski et al. | |
| 5,874,770 | A | 2/1999 | Saia et al. | |
| 5,875,531 | A | 3/1999 | Nellissen et al. | |
| 5,886,407 | A | 3/1999 | Polese et al. | |
| 5,889,325 | A | 3/1999 | Uchida et al. | |
| 5,912,606 | A | 6/1999 | Nathanson et al. | |
| 5,915,050 | A | 6/1999 | Russell et al. | |
| 5,972,737 | A | 10/1999 | Polese et al. | |
| 5,994,750 | A | 11/1999 | Yagi | |
| 6,021,048 | A | 2/2000 | Smith | |
| 6,164,933 | A * | 12/2000 | Tani et al. | 417/413.2 |
| 6,180,873 | B1 | 1/2001 | Bitko | |
| 6,201,682 | B1 | 3/2001 | Mooij et al. | |
| 6,203,291 | B1 * | 3/2001 | Stemme et al. | 417/413.3 |
| 6,207,234 | B1 | 3/2001 | Jiang | |
| 6,212,308 | B1 | 4/2001 | Donald | |
| 6,225,133 | B1 | 5/2001 | Yamamichi et al. | |
| 6,278,541 | B1 | 8/2001 | Baker | |
| 6,304,450 | B1 | 10/2001 | Dibene, II et al. | |
| 6,320,994 | B1 | 11/2001 | Donald et al. | |
| 6,323,447 | B1 | 11/2001 | Kondoh et al. | |
| 6,351,579 | B1 | 2/2002 | Early et al. | |
| 6,356,679 | B1 | 3/2002 | Kapany | |
| 6,373,356 | B1 | 4/2002 | Gutierrez et al. | |
| 6,396,012 | B1 | 5/2002 | Bloomfield | |
| 6,396,371 | B1 | 5/2002 | Streeter et al. | |
| 6,408,112 | B1 | 6/2002 | Bartels | |
| 6,446,317 | B1 | 9/2002 | Figueroa et al. | |
| 6,453,086 | B1 | 9/2002 | Tarazona | |
| 6,470,106 | B1 | 10/2002 | McClelland et al. | |
| 6,487,333 | B1 | 11/2002 | Fouquet | |
| 6,501,354 | B1 | 12/2002 | Gutierrez et al. | |
| 6,512,322 | B1 | 1/2003 | Fong et al. | |
| 6,515,404 | B1 | 2/2003 | Wong | |
| 6,516,504 | B1 | 2/2003 | Schaper | |
| 6,559,420 | B1 | 5/2003 | Zarev | |
| 6,623,256 | B1 * | 9/2003 | Takagi et al. | 417/413.2 |
| 6,633,213 | B1 | 10/2003 | Dove | |
| 2002/0037128 | A1 | 3/2002 | Burger et al. | |
| 2002/0146197 | A1 | 10/2002 | Yong | |
| 2002/0150323 | A1 | 10/2002 | Nishida et al. | |
| 2002/0168133 | A1 | 11/2002 | Saito | |
| 2003/0035611 | A1 | 2/2003 | Shi | |

FOREIGN PATENT DOCUMENTS

| | | | |
|---|---|---|---|
| EP | 0 398 583 | | 4/1994 |
| EP | 0 436 653 | | 6/1994 |
| FR | 2418539 | A | 9/1979 |
| FR | 2458138 | A1 | 10/1980 |
| FR | 2667396 | | 9/1990 |
| JP | SHO 36-18575 | | 10/1961 |
| JP | SHO 47-21645 | | 10/1972 |
| JP | 63-276838 | | 5/1987 |
| JP | 01-294317 | | 5/1988 |
| JP | 01 177 464 | | 7/1989 |
| JP | 06 117 377 | | 4/1994 |
| JP | 08-125487 | A | 5/1996 |
| JP | 9161640 | | 6/1997 |
| WO | WO 99/46624 | A1 | 9/1999 |

OTHER PUBLICATIONS

Marvin Glenn Wong, "A Piezoelectrically Actuated Liquid Metal Switch", May 2, 2002, patent application (pending, 12 pages of specification, 5 pages of claims, 1 page of abstract, and 10 sheets of drawings (Figs. 1-10).

Bhedwar, Homi C. et al. "Ceramic Multilayer Package Fabrication." Electronic Materials Handbook, Nov. 1989, pp. 460-469, vol. 1 Packaging, Section 4: Packages.

"Integral Power Resistors for Aluminum Substrate." IBM Technical Disclosure Bulletin, Jun. 1984, US, Jun. 1, 1984, p. 827, vol. 27, No. 1B, TDB-ACC-NO: NB8406827, Cross Reference: 0018-8689-27-1B-827.

KIm. Joonwon et al. "A Micromechanical Switch with Electrostatically Driven Liquid-Metal Droplet." Sensors and Actuators, A: Physical. v 9798, Apr. 1, 2002, 4 pages.

* cited by examiner

CLOSED-LOOP PIEZOELECTRIC PUMP

CROSS REFERENCE TO RELATED APPLICATIONS

This application is related to the following co-pending U.S. Patent Applications, being identified by the below enumerated identifiers and arranged in alphanumerical order, which have the same ownership as the present application and to that extent are related to the present application and which are hereby incorporated by reference:

Application Ser. No. 10010448-1, titled "Piezoelectrically Actuated Liquid Metal Switch", filed May 2, 2002 and identified by Ser. No. 10/137,691;

Application Ser. No. 10010529-1, "Bending Mode Latching Relay", and having the same filing date as the present application;

Application Ser. No. 10010531-1, "High Frequency Bending Mode Latching Relay", and having the same filing date as the present application;

Application Ser. No. 10010570-1, titled "Piezoelectrically Actuated Liquid Metal Switch", filed May 2, 2002 and identified by Ser. No. 10/142,076;

Application Ser. No. 10010571-1, "High-frequency, Liquid Metal, Latching Relay with Face Contact", and having the same filing date as the present application;

Application Ser. No. 10010572-1, "Liquid Metal, Latching Relay with Face Contact", and having the same filing date as the present application;

Application Ser. No. 10010573-1, "Insertion Type Liquid Metal Latching Relay", and having the same filing date as the present application;

Application Ser. No. 10010617-1, "High-frequency, Liquid Metal, Latching Relay Array", and having the same filing date as the present application;

Application Ser. No. 10010618-1, "Insertion Type Liquid Metal Latching Relay Array", and having the same filing date as the present application;

Application Ser. No. 10010634-1, "Liquid Metal Optical Relay", and having the same filing date as the present application;

Application Ser. No. 10010640-1, titled "A Longitudinal Piezoelectric Optical Latching Relay", filed Oct. 31, 2001 and identified by Ser. No. 09/999,590;

Application Ser. No. 10010643-1, "Shear Mode Liquid Metal Switch", and having the same filing date as the present application;

Application Ser. No. 10010644-1, "Bending Mode Liquid Metal Switch", and having the same filing date as the present application;

Application Ser. No. 10010656-1, titled "A Longitudinal Mode Optical Latching Relay", and having the same filing date as the present application;

Application Ser. No. 10010663-1, "Method and Structure for a Pusher-Mode Piezoelectrically Actuated Liquid Metal Switch", and having the same filing date as the present application;

Application Ser. No. 10010664-1, "Method and Structure for a Pusher-Mode Piezoelectrically Actuated Liquid Metal Optical Switch", and having the same filing date as the present application;

Application Ser. No. 10010790-1, titled "Switch and Production Thereof", filed Dec. 12, 2002 and identified by Ser. No. 10/317,597;

Application Ser. No. 10011055-1, "High Frequency Latching Relay with Bending Switch Bar", and having the same filing date as the present application;

Application Ser. No. 10011056-1, "Latching Relay with Switch Bar", and having the same filing date as the present application;

Application Ser. No. 10011064-1, "High Frequency Push-mode Latching Relay", and having the same filing date as the present application;

Application Ser. No. 10011065-1, "Push-mode Latching Relay", and having the same filing date as the present application;

Application Ser. No. 10011329-1, titled "Solid Slug Longitudinal Piezoelectric Latching Relay", filed May 2, 2002 and identified by Ser. No. 10/137,692;

Application Ser. No. 10011344-1, "Method and Structure for a Slug Pusher-Mode Piezoelectrically Actuated Liquid Metal Switch", and having the same filing date as the present application;

Application Ser. No. 10011345-1, "Method and Structure for a Slug Assisted Longitudinal Piezoelectrically Actuated Liquid Metal Optical Switch", and having the same filing date as the present application;

Application Ser. No. 10011397-1, "Method and Structure for a Slug Assisted Pusher-Mode Piezoelectrically Actuated Liquid Metal Optical Switch", and having the same filing date as the present application;

Application Ser. No. 10011398-1, "Polymeric Liquid Metal Switch", and having the same filing date as the present application;

Application Ser. No. 10011410-1, "Polymeric Liquid Metal Optical Switch", and having the same filing date as the present application;

Application Ser. No. 10011436-1, "Longitudinal Electromagnetic Latching Optical Relay", and having the same filing date as the present application;

Application Ser. No. 10011437-1, "Longitudinal Electromagnetic Latching Relay", and having the same filing date as the present application;

Application Ser. No. 10011458-1, "Damped Longitudinal Mode Optical Latching Relay", and having the same filing date as the present application;

Application Ser. No. 10011459-1, "Damped Longitudinal Mode Latching Relay", and having the same filing date as the present application;

Application Ser. No. 10020013-1, titled "Switch and Method for Producing the Same", filed Dec. 12, 2002 and identified by Ser. No. 10/317,963;

Application Ser. No. 10020027-1, titled "Piezoelectric Optical Relay", filed Mar. 28, 2002 and identified by Ser. No. 10/109,309;

Application Ser. No. 10020071-1, titled "Electrically Isolated Liquid Metal Micro-Switches for Integrally Shielded Microcircuits", filed Oct. 8, 2002 and identified by Ser. No. 10/266,872;

Application Ser. No. 10020073-1, titled "Piezoelectric Optical Demultiplexing Switch", filed Apr. 10, 2002 and identified by Ser. No. 10/119,503;

Application Ser. No. 10020162-1, titled "Volume Adjustment Apparatus and Method for Use", filed Dec. 12, 2002 and identified by Ser. No. 10/317,293;

Application Ser. No. 10020241-1, "Method and Apparatus for Maintaining a Liquid Metal Switch in a Ready-to-Switch Condition", and having the same filing date as the present application;

Application Ser. No. 10020242-1, titled "A Longitudinal Mode Solid Slug Optical Latching Relay", and having the same filing date as the present application;

Application Ser. No. 10020473-1, titled "Reflecting Wedge Optical Wavelength Multiplexer/Demultiplexer", and having the same filing date as the present application;

Application Ser. No. 10020540-1, "Method and Structure for a Solid Slug Caterpillar Piezoelectric Relay", and having the same filing date as the present application;

Application Ser. No. 10020541-1, titled "Method and Structure for a Solid Slug Caterpillar Piezoelectric Optical Relay", and having the same filing date as the present application;

Application Ser. No. 10030438-1, "Inserting-finger Liquid Metal Relay", and having the same filing date as the present application;

Application Ser. No. 10030440-1, "Wetting Finger Liquid Metal Latching Relay", and having the same filing date as the present application;

Application Ser. No. 10030521-1, "Pressure Actuated Optical Latching Relay", and having the same filing date as the present application;

Application Ser. No. 10030522-1, "Pressure Actuated Solid Slug Optical Latching Relay", and having the same filing date as the present application; and Application Ser. No. 10030546-1, "Method and Structure for a Slug Caterpillar Piezoelectric Reflective Optical Relay", and having the same filing date as the present application.

FIELD OF THE INVENTION

This invention relates generally to the field of fluid pumping. More particularly, this invention relates to methods and apparatus for using a piezoelectric pump with integrated sensing to provide a controlled delivery of fluid.

BACKGROUND

Fluid pumps are used extensively in many areas. In some areas, such as chemistry, medicine and biotechnology, relatively low fluid volumes and controlled flow rates are required. An example is the delivery of a pharmaceutical solution or suspension from a container to a delivery point. A number of piezoelectric pumps, including micro-pumps, have been developed. The amount of fluid pumped by a piezoelectric pump typically relates to the driving voltage and pulse width of the electrical signal used to energize the piezoelectric element. This provides an "open-loop" method for controlling the pump. The "open-loop" method does not provide sufficient accuracy for all applications.

SUMMARY

A closed-loop piezoelectric pump is disclosed for use in a fluid delivery system. A piezoelectric transducer in the pump operates to produce a pumping action by varying the volume of the pumping chamber. The piezoelectric transducer may be used to generate an acoustic pressure pulse within the fluid delivery system and to sense reflections of the acoustic pressure pulse caused by impedance changes downstream of the pump. Properties of the fluid path downstream of pump may be determined from the characteristics of the sensed reflections.

BRIEF DESCRIPTION OF THE DRAWINGS

The novel features believed characteristic of the invention are set forth in the appended claims. The invention itself, however, as well as the preferred mode of use, and further objects and advantages thereof, will best be understood by reference to the following detailed description of an illustrative embodiment when read in conjunction with the accompanying drawing(s), wherein:

DETAILED DESCRIPTION

Figure 1:
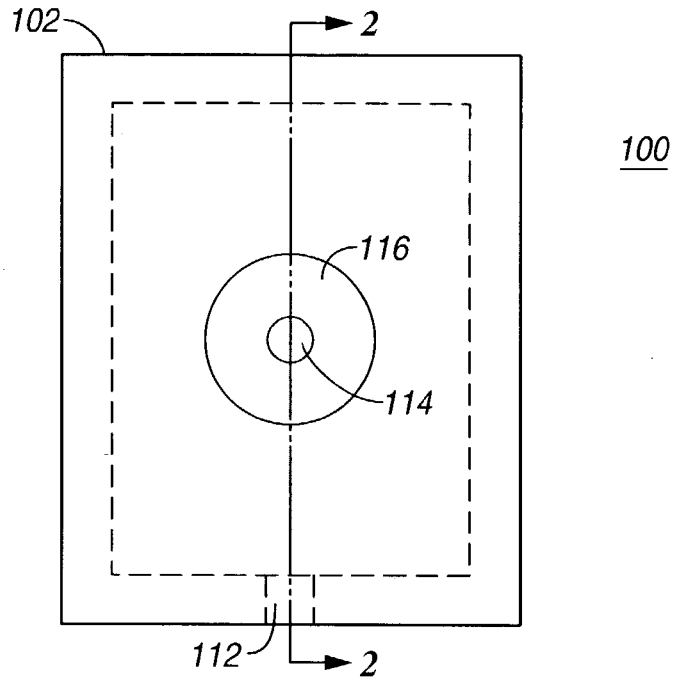
FIG. 1 is a diagrammatic representation of a piezoelectric pump in accordance with certain aspects of the present invention.

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described. In the description below, like reference numerals are used to describe the same, similar or corresponding parts in the several views of the drawings.

One aspect of the present invention is a closed loop, piezoelectric pump. The closed-loop pump includes a sensing element that may be used, for example, to measure the amount of chemical dispensed or the concentration of chemical in a mixing tank. More generally, information can be obtained about impedance changes in the fluid path downstream of the pump. In medical applications, for example, this means that blockage in blood vessels can be measured and the type of blockage characterized at locations remote from the location where the catheter is inserted into the blood vessel. This information can be used to "close the loop" for treatment. In one application, the breakup of a thrombosis in an anticoagulent dispensing application is sensed. In another application, the hardness and removal of plaque in blood vessels during removal by laser surgery is monitored, so that the appropriate laser power and number of pulses are used.

A diagrammatic representation of a first embodiment of a piezoelectric pump of the present invention is shown in FIG. 1. Referring to FIG. 1, the piezoelectric pump 100 comprises a substantially rigid pump housing 102. Fluid enters the pump through inlet port 112 and exits the pump through outlet port 114. The outlet 114 may also comprise a membrane 116 which is permeable to sound and acts as a flow restrictor.

Figure 2:
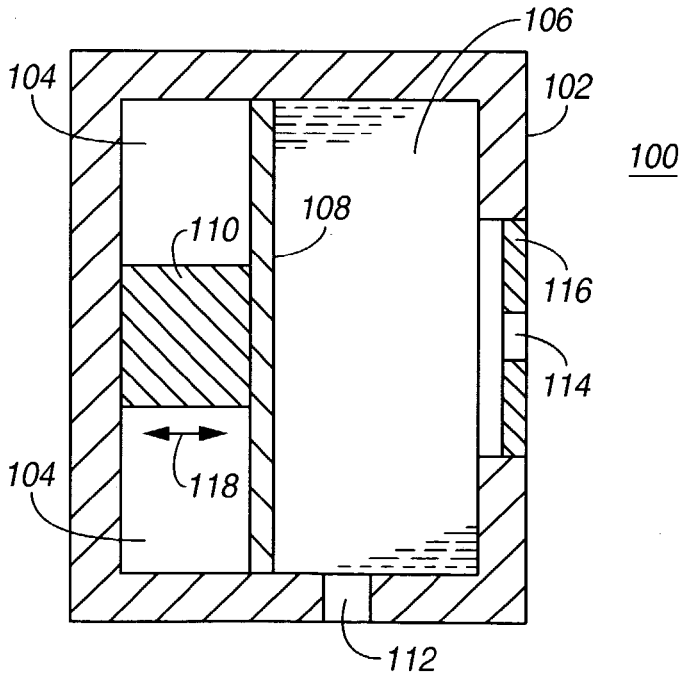
FIG. 2 is a sectional view of a piezoelectric pump utilizing a piezoelectric element in an extension mode in accordance with certain aspects of the present invention.

FIG. 2 is a sectional view through the section 2—2 of the pump shown in FIG. 1. Referring to FIG. 2, the piezoelectric pump 100 comprises a substantially rigid pump housing 102. The pump housing 102 is separated into a first chamber 104 and a second chamber 106 by a flexible diaphragm 108. The second chamber is referred to as the pumping chamber. One surface of a piezoelectric transducer 110 is coupled to the flexible diaphragm 108, while the other is coupled to the pump housing 102. One or more piezoelectric transducers may be used, and may be located in the first chamber or the second chamber or in both chambers. The piezoelectric transducer may be formed from any of a number of piezoelectric materials, including PZT and PZWT100. The pumping chamber has an input port or inlet 112, through which fluid is drawn into the pumping chamber, and an output port or outlet 114, through which fluid is expelled from the pumping chamber. The outlet 114 may also comprise a membrane 116 which acts as a flow restrictor and is permeable to sound. Other flow restriction devices may be used in place of the sound-permeable membrane, including devices such as diffusers/nozzles and valvular conduits. In operation, an electric voltage is applied across the piezoelectric transducer 110, which causes the piezoelectric transducer to move in the directions of the arrow 118, that is, in a direction substantially perpendicular to the surface of the diaphragm 108. In turn, the flexible diaphragm 108 is moved, either increasing or decreasing the volume of the pumping chamber 106. There are many ways to build the piezoelectric actuator portion of the pump. In addition to the extension element described above, other piezoelectric elements, such as bending and shearing elements may be used.

Figure 3:
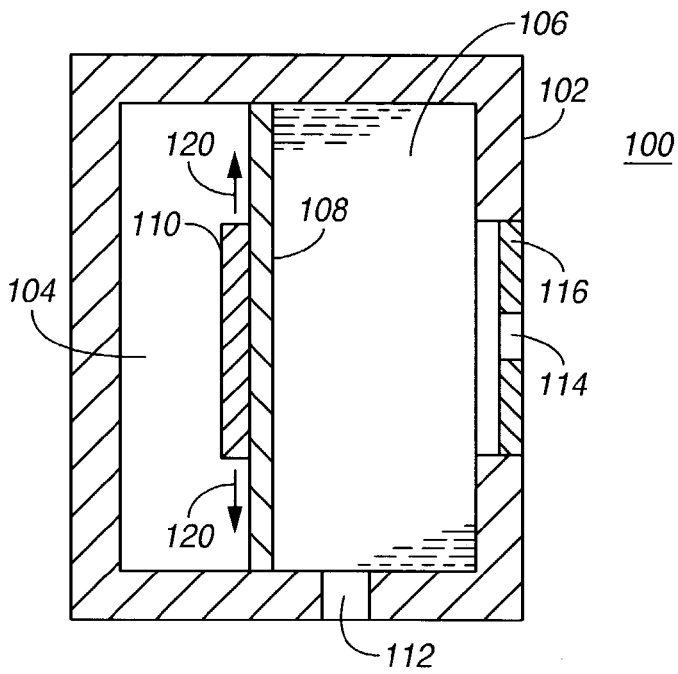
FIG. 3 is a sectional view of a piezoelectric pump utilizing a piezoelectric element in a bending mode in accordance with certain aspects of the present invention.

A sectional view of a second embodiment of a piezoelectric pump of the present invention is shown in FIG. 3. Referring to FIG. 3, the piezoelectric pump 100 comprises a substantially rigid pump housing 102. The pump housing 102 is separated into a first chamber 104 and a pumping chamber 106 by a flexible diaphragm 108. One surface of a piezoelectric transducer 110 is coupled to the flexible diaphragm. One or more piezoelectric transducers may be used, and may be located in the first chamber or the pumping chamber or both. For example, a second piezoelectric transducer may be placed in the pumping chamber on the opposite side of the diaphragm from the transducer 110. The second piezoelectric transducer would be operated out-of-phase with the first piezoelectric transducer. The pumping chamber has an inlet 112, through which fluid is drawn into the pumping chamber, and an outlet 114, through which fluid is expelled from the pumping chamber. The outlet 114 may also comprise a membrane 116 that is permeable to sound. In operation an electric voltage is applied across the piezoelectric transducer 110, which causes the piezoelectric transducer to move in the directions of the arrows 120, that is, in a direction substantially parallel to the surface of the diaphragm 108. This, in turn, causes the flexible diaphragm 108 to bend, either increasing or decreasing the volume of the pumping chamber 106.

Figure 4:
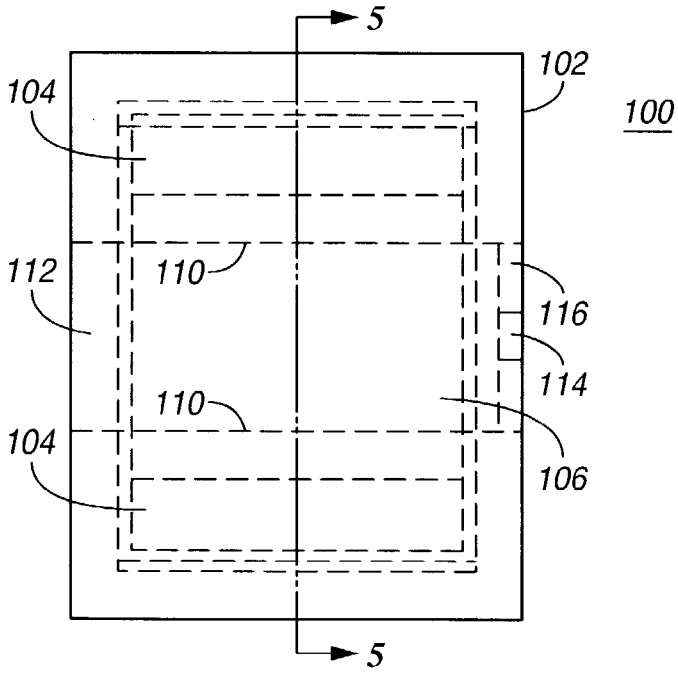
FIG. 4 is a diagrammatic representation of a piezoelectric pump utilizing a piezoelectric element in a shearing mode in accordance with certain aspects of the present invention.

A diagrammatic representation of a further embodiment of a piezoelectric pump of the present invention is shown in FIG. 4. Referring to FIG. 4, the piezoelectric pump 100 comprises a substantially rigid pump housing 102. The pump housing 102 is separated into a first chamber 104 and a pumping chamber 106 by piezoelectric elements 110. The piezoelectric elements 110 provide a self-actuated diaphragm. The pumping chamber has an inlet 112, through which fluid is drawn into the pumping chamber, and an outlet 114, through which fluid is expelled from the pumping chamber. The outlet 114 may also comprise a membrane 116 that is permeable.

Figure 5:
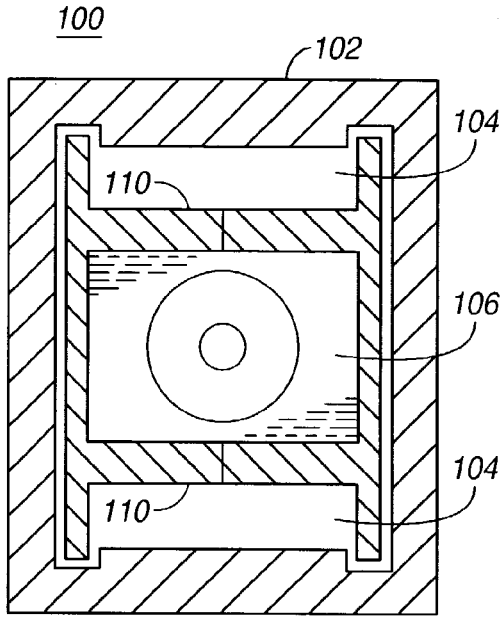
FIG. 5 is a sectional view of a piezoelectric pump utilizing a piezoelectric element in a shearing mode in accordance with certain aspects of the present invention.
Figure 6:
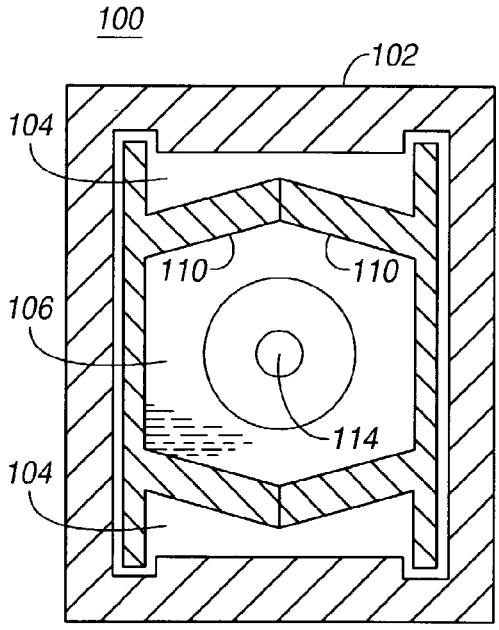
FIG. 6 is a further sectional view of a piezoelectric pump in accordance with certain aspects of the present invention utilizing a piezoelectric element in a shearing mode and showing an expanded pumping chamber.
Figure 7:
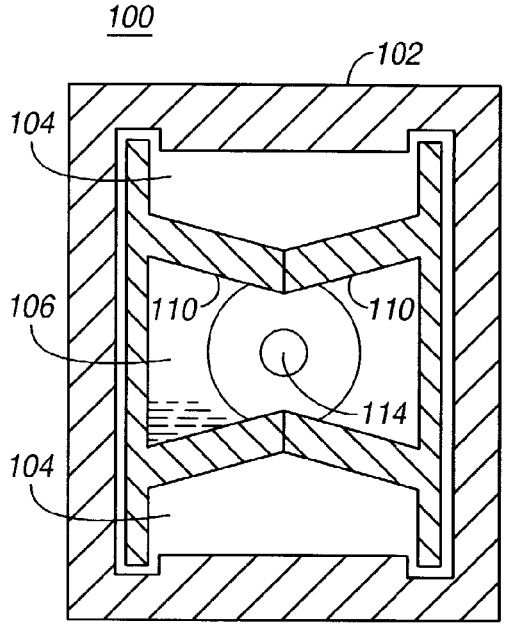
FIG. 7 is a further sectional view of a piezoelectric pump in accordance with certain aspects of the present invention utilizing a piezoelectric element in a shearing mode and showing a contracted pumping chamber.

FIG. 5 shows a sectional view of the piezoelectric pump shown in FIG. 4, the section denoted by 5—5 in FIG. 4. In operation, an electric voltage is applied across the piezoelectric transducer 110, which causes the piezoelectric transducer to deflect in a shear mode. When the voltage is applied in one direction, the volume of the pumping chamber 106 is increased, as shown in FIG. 6. This causes fluid to be drawn into the pump through the inlet. When the voltage is applied in the opposite direction, the volume of the pumping chamber is decreased, as shown in FIG. 7. This causes fluid to be expelled from the pump through the outlet 114.

Figure 8:
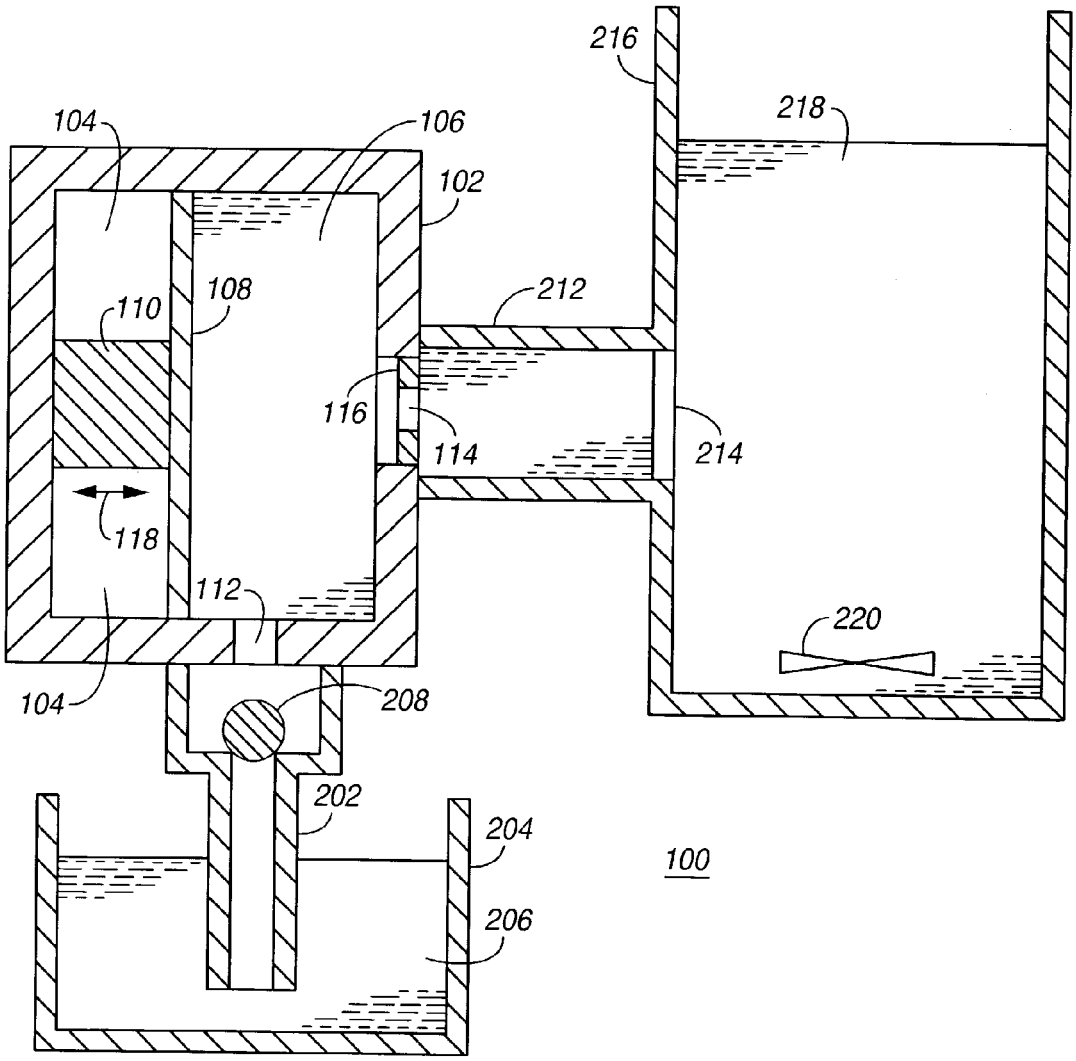
FIG. 8 is a diagrammatic representation of a fluid mixing system incorporating a piezoelectric pump of the present invention.

FIG. 8 is a diagrammatic representation of a fluid pumping system incorporating a piezoelectric pump. For clarity, the various components of the system are drawn to different scales. The piezoelectric pump 100 has been described above. In this application, the pump 100 draws fluid through inlet tube 202 from a fluid reservoir 204 containing a first fluid 206. The inlet tube 202 is coupled to the inlet 112 of the pump through check valve 208. The check valve 208 prevents fluid from re-entering the fluid reservoir when the volume of the second pump chamber 106 is decreased. Other flow restriction devices may be used, including passive devices such as diffusers/nozzles, flaps and valvular conduits, and active devices such as piezoelectric valves. During the pumping operation, the actuator increases the volume of the pump relatively quickly, drawing fluid from the reservoir through the valve 208. The pump outlet is connected via delivery tube 212 and opening 214 to mixing tank 216 that contains a second fluid 218. Relatively little fluid is drawn into the pumping chamber through the flow restrictor due to its fluid drag effects. In this application, fluid 206 from the fluid reservoir 204 is mixed with fluid 218. A stirrer 220 may be positioned in the mixing tank to facilitate mixing of the fluids.

Figure 9:
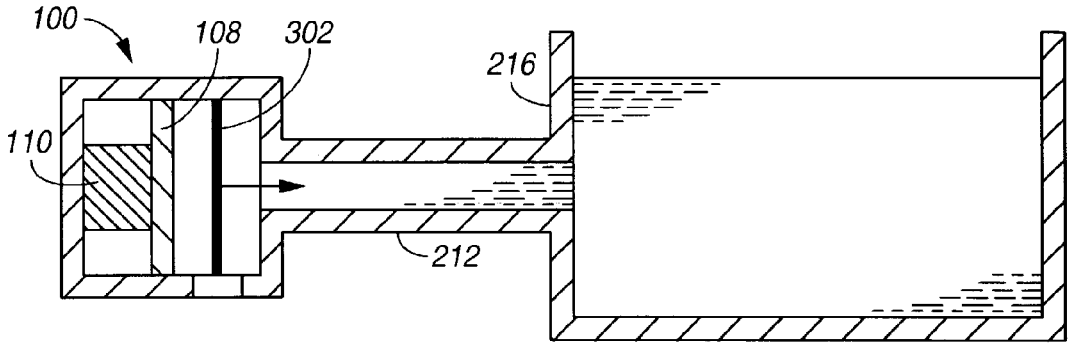
FIG. 9–14 depict the operation of a piezoelectric pump with integrated sensing, in accordance with certain aspects of the present invention.
Figure 10:
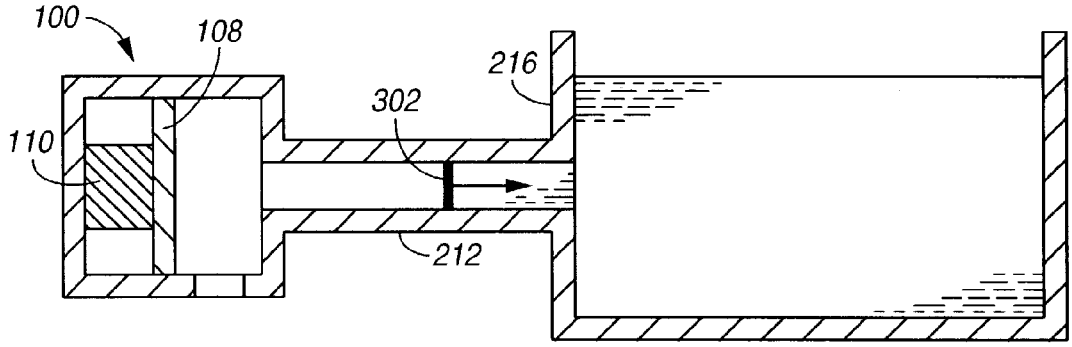
Figure 11:
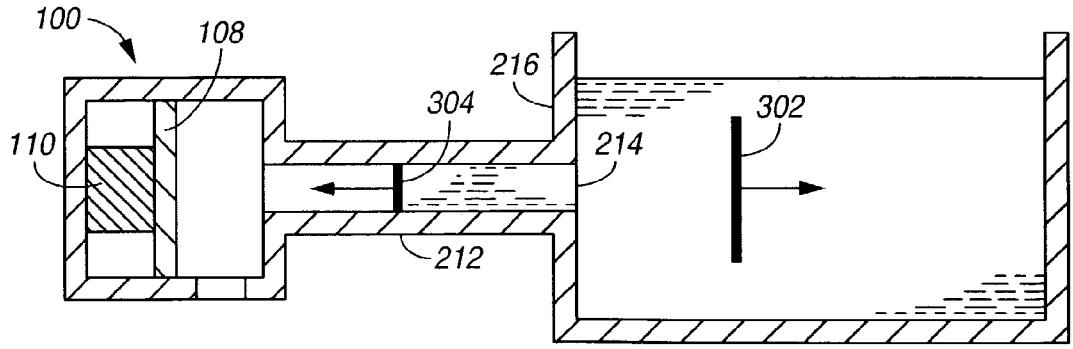
Figure 12:
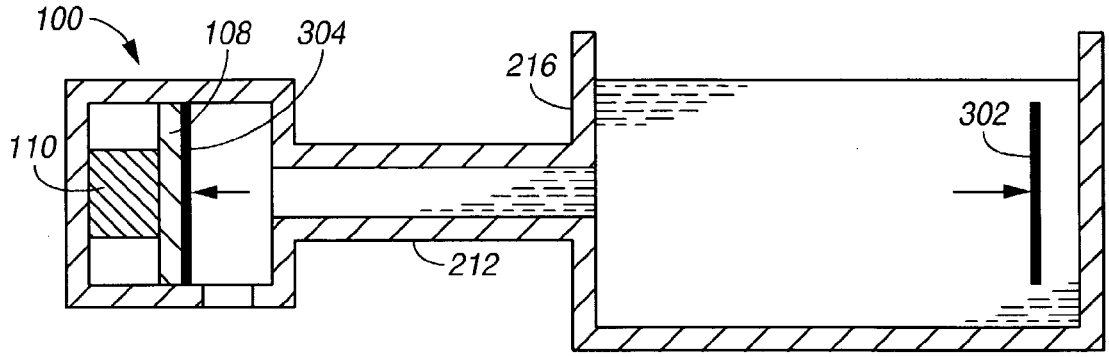

In accordance with one aspect of the present invention, it is recognized that the motion of the piezoelectric transducer generates a pressure fluctuation in the fluid and may be used as SONAR transducer. In prior systems, this pressure fluctuation is generally confined to the working chamber of the pump. However, in accordance with the present invention, the pressure fluctuation is allowed to propagate, as a sound wave in the fluid, through the outlet of the pump and into the delivery tube. This is shown schematically in FIGS. 8–13 for a particular embodiment. Referring to FIG. 9, in operation, the piezoelectric element 110 of pump 100 is activated, causing diaphragm 108 to move and generate a pressure pulse 302 in the pumping chamber of the pump. The flow restrictor in the outlet is chosen so as to have an acoustic impedance that is closely matched to the acoustic impedance of the fluid. As a consequence, a substantial portion of pressure pulse is transmitted through the flow restrictor with little distortion and enters the delivery tube 212, as shown in FIG. 10. Preferably, the direction of the pump displacement is oriented towards the output port of the pump. As shown in FIG. 11, the pressure pulse propagates along the delivery tube until it reaches the interface 214 between the delivery tube 212 and the mixing tank 216. Because of the mismatch in the acoustic impedance between the tube and the tank, a portion 304 of the pressure pulse is reflected and propagates back along the tube towards the pump. The remainder of the pressure pulse 302 propagates into the mixing tank. Referring to FIG. 12, the reflected pressure pulse 304 passes back through the flow restrictor and reaches the pump diaphragm 108. The force applied on the pump diaphragm is transmitted to the piezoelectric element and induces an electrical voltage across the element. In this manner, the piezoelectric element acts as an acoustic pressure sensor, where the electrical voltage is the sensed signal. A signal analyzer may be electrically connected to the piezoelectric element (via suitable signal conditioning circuitry), and the sensed signal may be analyzed to infer properties of the pump, the delivery tube, and the fluid in the delivery tube and the mixing tank.

Figure 13:
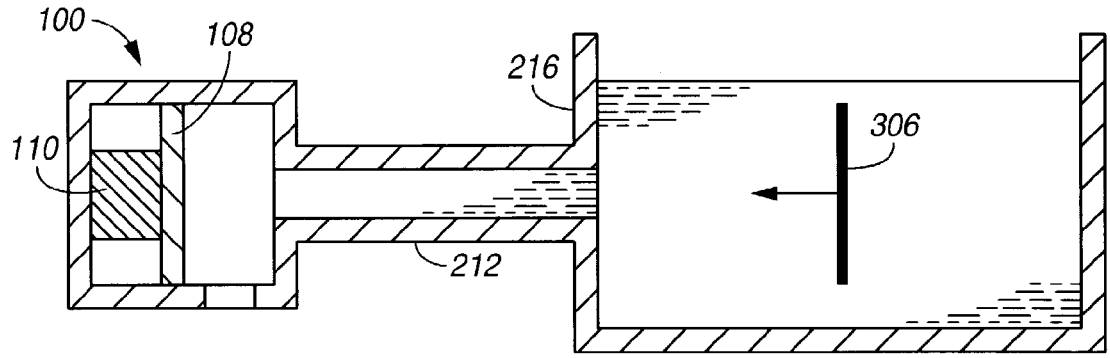
Figure 14:
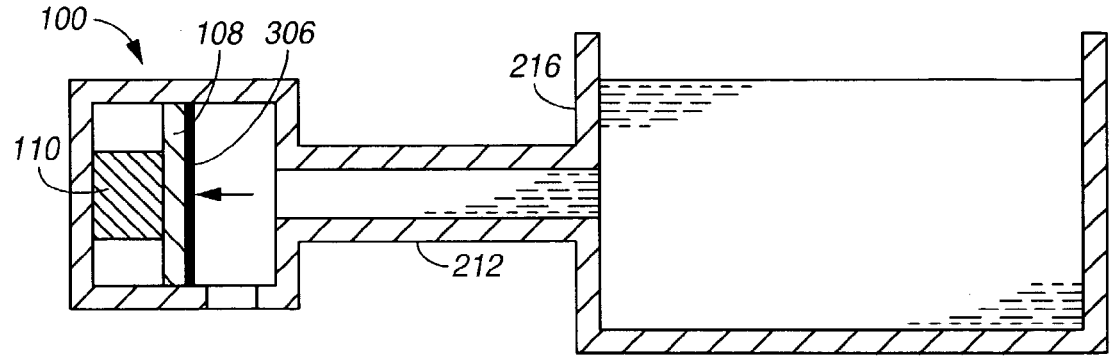

Referring to FIG. 13, the pressure pulse (302 in FIG. 12) is reflected from the far wall of the mixing tank 216 and propagates back towards the tube/tank interface as reflected pressure pulse 306. A portion of the pressure pulse will reenter the delivery tube 212 and propagate back to the pump. As shown in FIG. 14, the reflected pressure pulse finally reaches the diaphragm 108 and is sensed by the piezoelectric element 110 as described above. The characteristics of the sensed signal provide more information from which the properties of the fluid in the mixing tank can be inferred.

The initial pressure pulse may the pulse generated by normal pumping motion, or it may be specially generated as a test signal. Preferably the pulse should have short duration to allow time separation of the reflected pulses. Such short duration pulses have a broad frequency spectrum. An example of such a pulse is a square wave.

In a further embodiment of the present invention, the pump is operated in a closed-loop mode. In this mode of operation, the properties of the sensed signal are used to adjust the pumping action of the pump. In this manner, desired fluid properties may be obtained with high accuracy.

Figure 15:
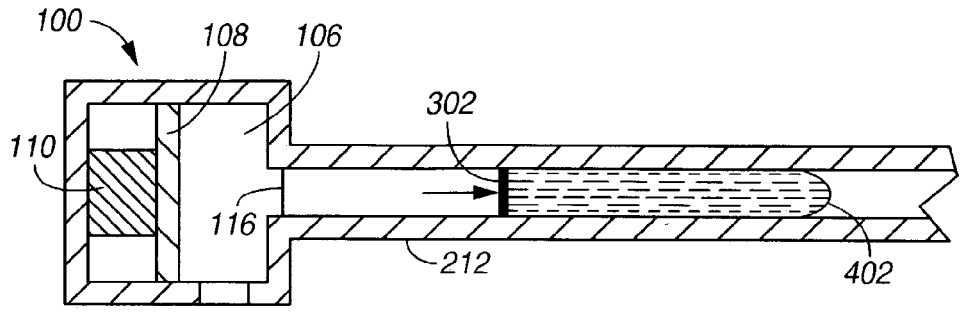
FIG. 15 is a diagrammatic representation of a fluid delivery system incorporating a piezoelectric pump of the present invention.
Figure 16:
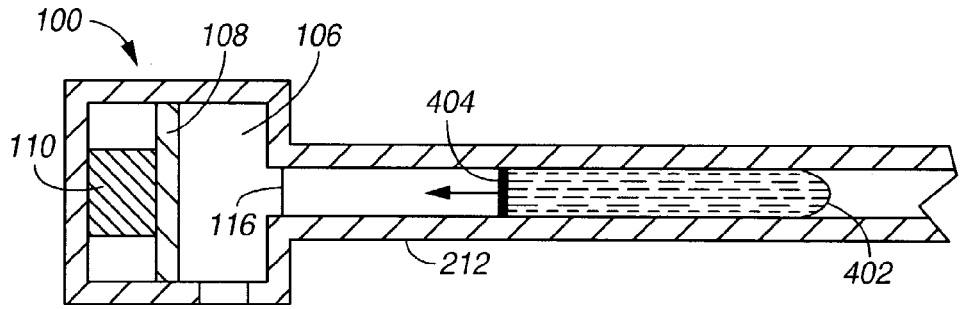
FIG. 16 is a further diagrammatic representation of a fluid delivery system incorporating a piezoelectric pump of the present invention.

In a further embodiment of the present invention, depicted in FIG. 15 and FIG. 16, a generated pressure pulse is used to determine the length of a slug of pumped fluid in a delivery tube. Referring to FIG. 15, a piezoelectric pump 100 is coupled to a delivery tube 212. A pressure pulse 302 is generated by piezoelectric transducer 110 acting on the moveable diaphragm 108. The pressure passes through flow restrictor 116 with little loss of energy. The fluid slug occupies the pumping chamber 106 and the interior of the delivery tube 212. The end of the slug is denoted by the surface 402. Referring now to FIG. 16, when the pressure pulse encounters the acoustic impedance discontinuity at the end 402 of the slug, a reflected pulse 404 is generated which propagates back up the delivery tube to the pump. The reflected pulse passes through the flow restrictor and is sensed by the piezoelectric transducer 110. The resulting response signal is then analyzed. In one embodiment, the propagation time of the pulse and the sound speed in the fluid are used to determine the length of the fluid slug. Additionally, if the area of the fluid delivery tube is known, the volume of fluid in the slug can be calculated. This provides a measure of the volume of fluid that has been dispensed. In a further embodiment, a relief line is provided to ensure that the delivery tube empties between pumping cycles. The relief line relieves the pressure in the delivery tube up-stream of the fluid slug in the delivery tube.

Figure 17:
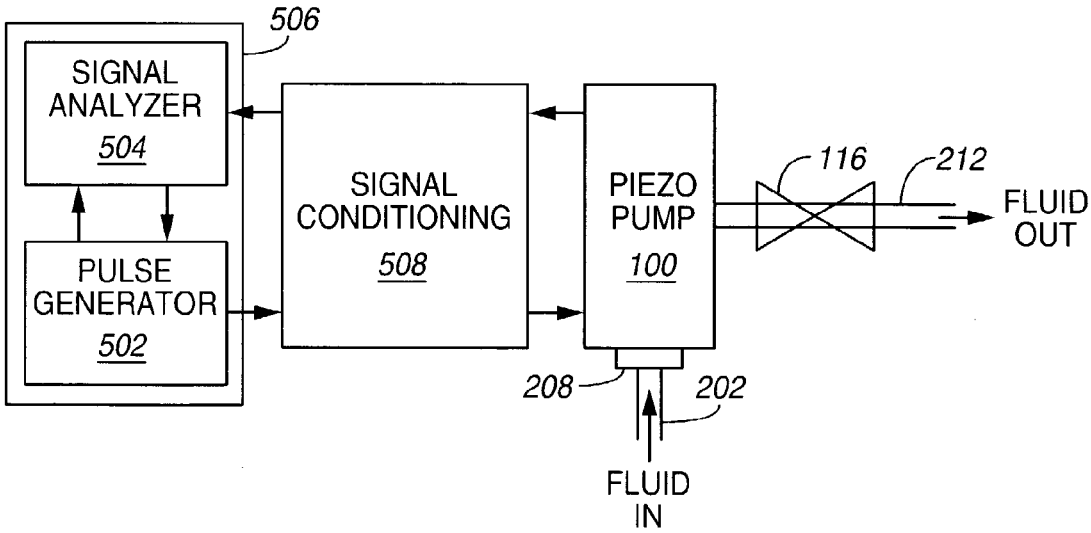
FIG. 17 is a diagrammatic representation of a closed-loop piezoelectric pump system in accordance with certain aspects of the present invention.

An overview of a system incorporating a closed-loop piezoelectric pump is shown in FIG. 17. Referring to FIG. 17, a pulse generator 502 is provided to generate signals for controlling the piezoelectric pump 100. An analyzer 504 is provided to receive signals from the piezoelectric pump 100. The pulse generator 502 and analyzer 504 realized by a general purpose computer 506 or an equivalent device such as a microprocessor based computer, digital signal processor, micro-controller, dedicated processor, custom circuit, ASICS and/or dedicated hard wired logic device. The pulse generator 502 and analyzer 504 are coupled to the piezoelectric pump via signal conditioner 508. The analyzer may utilize such characteristics as the time elapsed between the generation of the pulse and the sensing of the reflected pulses or the transfer function between the sensed signals and the generated signal. In one embodiment, the analyzer is calibrated by using a system with known acoustical properties. The analyzer and pulse generator are coupled to provide a closed-loop control system by which the flow of fluid dispensed by the pump can be controlled. The piezoelectric pump 100 draws fluid in though the input tube 202 and fluidic valve 208 and dispenses it through delivery tube 212. A flow restrictor 116 is provided to restrict flow of fluid back into the pump and allow passage of sound pulses generated by the piezoelectric transducer in the pump and by reflections of those sound pulses. If only monitoring is required (i.e. no pumping action) the flow restrictor may not be required.

Those of ordinary skill in the art will recognize that the present invention has been described in terms of exemplary embodiments based upon use of a piezoelectric transducer. However, the invention should not be so limited, since the present invention could be implemented using equivalent structural arrangements.

While the invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims.

What is claimed is:

1. A piezoelectric pump comprising:

a pump housing;

a movable diaphragm located within the pump housing and defining a pumping chamber within the pump housing, the pumping chamber having an inlet for admitting fluid into the pumping chamber and an outlet for emitting fluid;

a piezoelectric transducer coupled to the moveable diaphragm and operable to move the diaphragm and thereby change the volume of the pumping chamber, wherein the piezoelectric transducer is adapted to sense pressure fluctuations in the pumping chamber;

a fluidic valve, operable to restrict fluid flow from the pumping chamber through the inlet; and a flow restrictor, operable to restrict fluid into the pumping chamber through the outlet, wherein the flow restrictor has an acoustic impedance approximately equal to the acoustic impedance of the fluid, so that reflection of sound from the flow restrictor is small relative to transmission of sound through the flow restrictor.

2. A piezoelectric pump in accordance with claim 1, wherein the piezoelectric transducer is coupled to the pump housing and is configured to deform in an extensional mode substantially perpendicular to the moveable diaphragm.

3. A piezoelectric pump in accordance with claim 1, wherein the piezoelectric transducer is configured to deform in an extensional mode substantially parallel to the to diaphragm to bend the moveable diaphragm.

4. A piezoelectric pump in accordance with claim 1, wherein the piezoelectric transducer is configured to deform in a shear mode substantially perpendicular to the moveable diaphragm.

5. A piezoelectric pump in accordance with claim 1, wherein the moveable diaphragm comprises at least one piezoelectric transducer configured to deform in a shear mode.

6. A piezoelectric pump in accordance with claim 1, further comprising a fluid reservoir coupled by a fluid path to the inlet.

7. A piezoelectric pump comprising:

a pump housing;

a movable diaphragm located within the pump housing and defining a pumping chamber within the pump housing, the pumping chamber having an inlet for admitting fluid into the pumping chamber and an outlet for emitting fluid;

a piezoelectric transducer coupled to the moveable diaphragm and operable to move the diaphragm and thereby change the volume of the pumping chamber, wherein the piezoelectric transducer is adapted to sense pressure fluctuations in the pumping chamber, wherein the piezoelectric transducer is operable to generate a sound pulse in a fluid path downstream of the piezoelectric pump and to generate an electrical signal in response to reflections of the sound pulse; and further comprising a signal analyzer, electrically coupled to the piezoelectric transducer, for determining physical properties of the fluid from the electrical signal generated in response to reflections of the sound pulse.

8. A piezoelectric pump in accordance with claim 7, further comprising a fluid mixing tank, coupled by a fluid path to the outlet, wherein the signal analyzer is operable to determine physical properties of the fluid in the fluid mixing tank from the electrical signal generated in response to reflections of the sound pulse in the fluid mixing tank.

9. A piezoelectric pump in accordance with claim 7, further comprising a fluid delivery tube coupled to the outlet, wherein the signal analyzer is operable to determine one or more physical properties of the fluid in the fluid path downstream of the pump from the electrical signal generated in response to reflections of the sound pulse in the fluid path downstream of the pump.

10. A piezoelectric pump in accordance with claim 9, further comprising a fluid relief tube adapted to ensure removal of fluid from the fluid delivery tube between pumping cycles.

11. A method for sensing physical properties of a fluid path downstream of a piezoelectric pump, the pump having a pumping chamber bounded in part by a movable diaphragm activated by a piezoelectric transducer, the method comprising:

applying an electrical excitation signal to the piezoelectric transducer to generate an acoustic pressure pulse in the fluid path downstream of a piezoelectric pump;

sensing an electrical response signal produced by the piezoelectric transducer by reflections of the acoustic pressure pulse in the fluid path downstream of the piezoelectric pump; and analyzing the electrical response signal to determine physical properties of the fluid path downstream of the piezoelectric pump.

12. A method for measuring physical properties of a fluid delivery system in accordance with claim 11, wherein the analyzing comprises:

estimating the time elapsed between the generation of the excitation signal and the arrival of the response signal.

13. A method for measuring physical properties of a fluid delivery system in accordance with claim 11, wherein the analyzing comprises:

estimating a transfer function between the excitation signal and the response signal; and comparing properties of the transfer function to a database of known properties.

14. A method for measuring physical properties of a fluid delivery system in accordance with claim 11, wherein the physical properties are at least one of density, concentration, sound speed and viscosity of the fluid.

15. A method for measuring physical properties of a fluid delivery system in accordance with claim 11, further comprising:

calibrating the system using a fluid delivery system with known physical properties.

16. A method for measuring physical properties of a fluid delivery system in accordance with claim 11, further comprising:

adjusting the operation of the piezoelectric pump in response to the response signal.

17. A method for measuring physical properties of a fluid delivery system in accordance with claim 11, wherein the piezoelectric transducer applies a force to the diaphragm that is substantially perpendicular to the surface of the diaphragm.

18. A method for measuring physical properties of a fluid delivery system in accordance with claim 17, wherein the piezoelectric transducer is configured to deform in an extensional mode.

19. A method for measuring physical properties of a fluid delivery system in accordance with claim 11, wherein the piezoelectric transducer is configured to deform in a shear mode.

20. A method for measuring physical properties of a fluid delivery system in accordance with claim 19, wherein the piezoelectric transducer forms at least part of the diaphragm.

21. A method for measuring physical properties of a fluid delivery system in accordance with claim 11, wherein the piezoelectric transducer is configured to apply forces to the diaphragm that are substantially parallel to the surface of the diaphragm, thereby bending the diaphragm.

22. A method for measuring physical properties of a fluid delivery system having a piezoelectric pump, comprising:

acoustically coupling a piezoelectric transducer of the piezoelectric pump to fluid in the fluid delivery system;

generating a sound pulse in the fluid by applying an electrical excitation signal to the piezoelectric transducer;

sensing an electrical response signal generated in the piezoelectric transducer by reflections of the sound pulse in the fluid delivery system; and analyzing the electrical response signal to determine physical properties of the fluid or the fluid delivery system.

23. A method for measuring physical properties of a fluid delivery system in accordance with claim 22, wherein the fluid delivery system includes a blood vessel.

24. A method for measuring physical properties of a fluid delivery system in accordance with claim 23, wherein the physical properties include the hardness of the blood vessel.

25. A method for measuring physical properties of a fluid delivery system in accordance with claim 22, wherein the fluid delivery system dispenses anticoagulent and wherein the physical properties include the degree of breakup of a thrombosis in blood.

* * * * *